US005895172A

United States Patent [19]

Grembowicz et al.

[11] Patent Number: 5,895,172

[45] **Date of Patent: *Apr. 20, 1999**

[54] CONTROL SYSTEM AND METHOD FOR OPERATING AN ASPHALT PAVER SCREED BURNER SYSTEM

[75] Inventors: Conrad G. Grembowicz, Peoria; Lee E. Huffman, Princeville; Wade D. Samson, Sycamore, all of Ill.

[73] Assignee: Caterpillar Inc., Peoria, Ill.

[ * ] Notice: This patent is subject to a terminal disclaimer.

[21] Appl. No.: 08/884,910

[22] Filed: Jun. 30, 1997

[51] Int. Cl.[6] ..... E01C 23/14

[52] U.S. Cl. ..... 404/79; 431/6

[58] Field of Search ..... 404/77, 79, 95, 404/84.05; 431/6, 18, 62, 63

[56] References Cited

U.S. PATENT DOCUMENTS

| | | | |
|---|---|---|---|
| 3,975,137 | 8/1976 | Hapgood | 431/79 |
| 4,561,800 | 12/1985 | Hatakenaka et al. | 404/79 |
| 4,699,586 | 10/1987 | Snyder | 431/6 |
| 4,926,797 | 5/1990 | Butler | 122/15 |
| 5,139,362 | 8/1992 | Richter et al. | 404/95 |
| 5,245,196 | 9/1993 | Caballfin | 250/554 |
| 5,259,693 | 11/1993 | Raymond | 404/95 |
| 5,381,660 | 1/1995 | Lovingh et al. | 60/303 |
| 5,417,516 | 5/1995 | Birtchet | 404/71 |
| 5,607,254 | 3/1997 | Grembowicz et al. | 404/79 |

OTHER PUBLICATIONS

T F Trading, Sales Brochure, Fredensborg, Denmark "Ignition Box Type TF-1B" and Ignition Box FC-12V and FC-24V.

*Primary Examiner*—Tamara L. Graysay
*Assistant Examiner*—Sunil Singh
*Attorney, Agent, or Firm*—David M. Masterson; Mario J. Donato

[57] ABSTRACT

In one aspect of the present invention, an automatic screed temperature control is disclosed. The control senses the screed temperature and compares the screed temperature to a lower set point. In response to the screed temperature being less than the lower set point, the control causes fuel to dispense into the combustion chamber and subsequently causes the fuel to ignite in order to heat the screed. The screed is heated until the screed temperature becomes greater than an upper set point.

8 Claims, 5 Drawing Sheets

CONTROL SYSTEM AND METHOD FOR OPERATING AN ASPHALT PAVER SCREED BURNER SYSTEM

TECHNICAL FIELD

This invention relates generally to the field of asphalt paver control and, more particularly, to a control system and method for automatically controlling the temperature of an asphalt paver screed.

BACKGROUND ART

Asphalt pavers include a hopper for receiving paving material and a conveyor system for transferring the paving material from the hopper for discharge on the roadbed. Screw augers spread the material on the roadbed in front of a floating screed, which is connected to the paving machine by pivoting tow or draft arms. The screed functions to format and compact the paving material distributed by the augers, ideally leaving the finished road with a uniform, smooth surface.

It is important that the temperature of the screed is accurately controlled to an optimum temperature for "working" the paving material. If the screed temperature is controlled too low, then the paving material may adhere to the screed or be hard to work. But, if the screed temperature is controlled too high, the screed may warp or the paving material may be damaged. Traditionally, temperature control of an asphalt paver screed is done manually, wherein a plurality of burners must be individually lit manually and monitored manually. This is a time consuming process, and oftentimes does not produce accurate temperature control. It is thus desirable to accurately control the screed temperature in an automatic fashion so that overheating or underheating does not occur.

The present invention is directed to overcoming one or more of the problems as set forth above.

SUMMARY OF THE INVENTION

In one aspect of the present invention, an automatic screed temperature control is disclosed. The control senses the screed temperature and compares the screed temperature to a lower set point. In response to the screed temperature being less than the lower set point, the control causes fuel to dispense into the combustion chamber and subsequently causes the fuel to ignite in order to heat the screed. The screed is heated until the screed temperature becomes greater than an upper set point.

BRIEF DESCRIPTION OF THE DRAWINGS

For a better understanding of the present invention, reference may be made to the accompanying drawings in which.

DESCRIPTION OF A PREFERRED EMBODIMENT OF THE INVENTION

Figure 1:
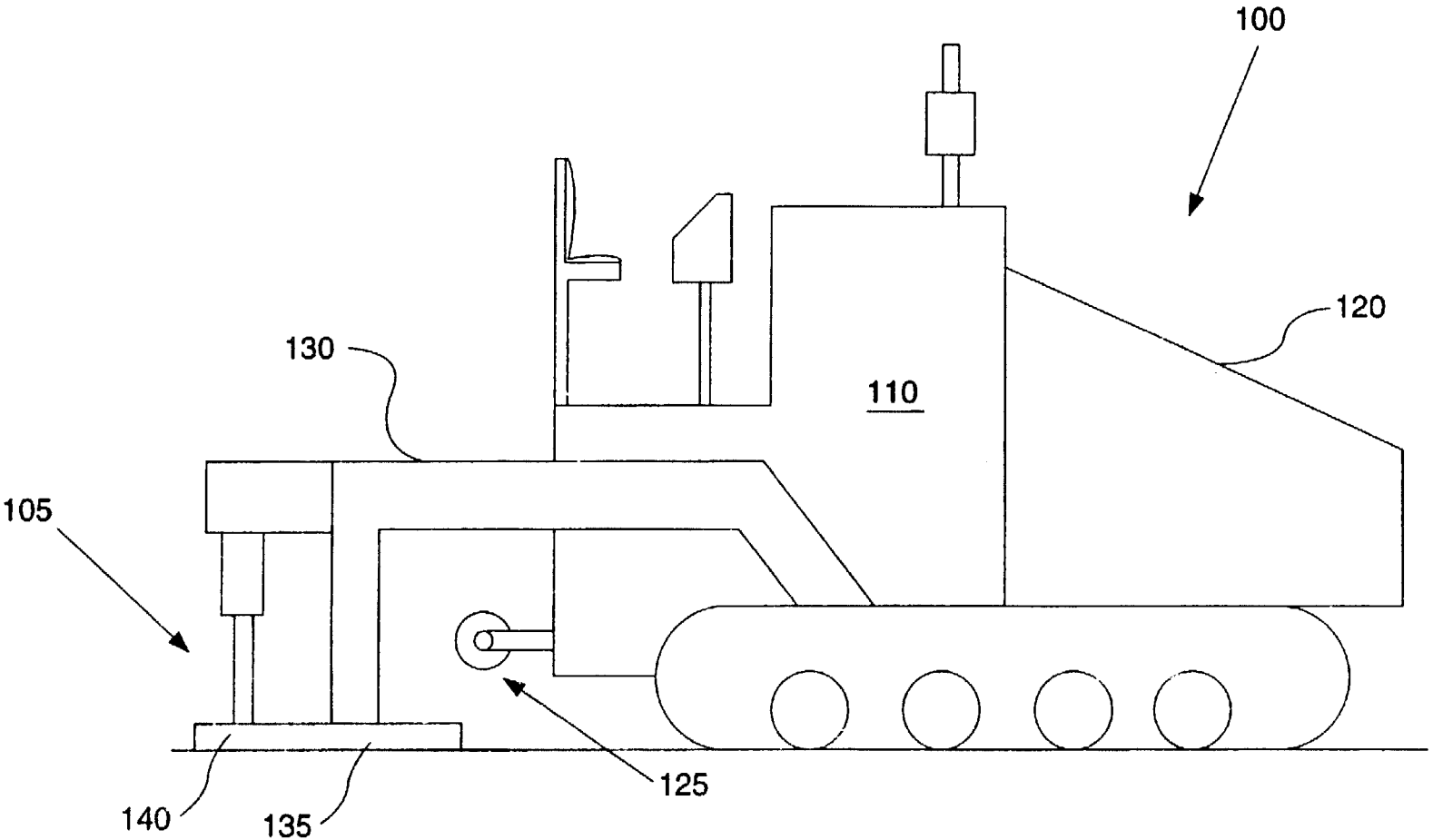
FIG. 1 illustrates a side view of an asphalt paver.

Referring now to the drawings, FIG. 1 illustrates a paver 100. The paver 100 may be of the rubber tire or crawler track type and includes a floating screed assembly 105. The paver 100 has a chassis 110 through which dual feed conveyors carry paving material, such as asphalt material, from a feed hopper 120 located at the front of the paver 100. Spreader augers 125, also referred to as spreading screws, are disposed transversely to and at the rear of the chassis 110. The augers 125 distribute the asphalt material transversely to the direction of travel of the paver 100. The material is spread over the desired width of a strip of pavement. The thickness and width of the pavement is established by the material-compacting, screed assembly 105. As shown, the screed assembly 105 is attached to the chassis 110 by a pair of draft arms 130. Preferably, the screed assembly 105 includes a main screed 135 and an extendable or extension screed 140. The main screed 135 is formed in two sections, one on each side of the center line of the paver. The extension screed 140 is mounted to each of the main screed sections.

Figure 2:
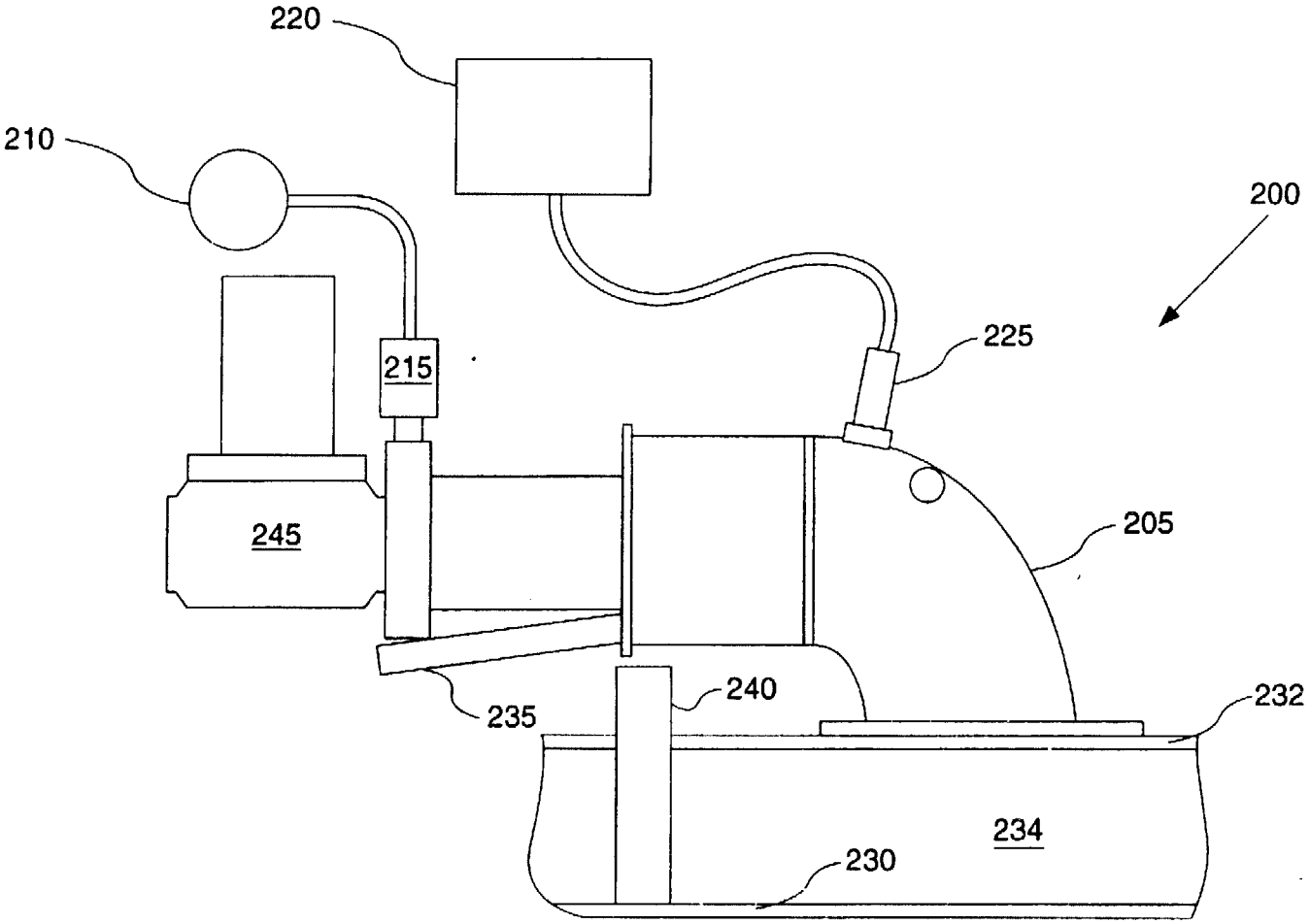
FIG. 2 illustrates a planer view of a burner assembly.

The present invention is directed toward automatically controlling the temperature of each screed plate. Reference is now made to FIG. 2, which illustrates a burner assembly 200 (hereinafter referred to as a burner). The burner 200 includes a combustion chamber 205 that is used to contain a gaseous mixture of fuel and air. The combustion chamber 205 is connected to screed cover 232, which is connected to screed support frame 234. Screed support frame 234 defines a cavity between screed cover 232 and screed plate 230, wherein once combustion occurs within the combustion chamber 205, the resultant flame is at least partially disposed within the cavity, which is connected to screed plate 230, thereby heating screed plate 230. A temperature sensor 240 monitors the temperature of the screed plate 230. An electrically controlled fuel pump 210 supplies fuel to a solenoid actuated fuel valve 215 in response to the screed plate temperature being less than a lower desired temperature. For example, the fuel may be in the form of a liquid or gas, such as: diesel fuel or propane. Note, if propane is to be used, then a pump is not required.

Upon being energized, the fuel valve 215 dispenses fuel into the combustion chamber 205. A voltage source, such as a battery, energizes an electronic glow plug 225 to ignite the gaseous mixture. A variable speed blower 245 forces air across the combustion chamber to further the ignition. The resulting combustion heats the screed plate 230. Although an electronic glow plug assembly is discussed, those skilled in the art will recognize that an ignition coil/spark plug assembly may instead be utilized. In that case, an ignition coil would energize the spark plug to ignite the gaseous mixture.

An optical sensor 235 detects when ignition first occurs. After ignition occurs, the voltage source 220 is de-energized. Thereafter, the blower 245 forces air at a high speed to further the combustion. Once the screed temperature reaches an upper desired temperature, the fuel pump 210 and fuel valve 215 are de-energized. The blower 245, however, continues to run in order to circulate the air and purge gases/smoke from the combustion chamber 205.

Figure 3:
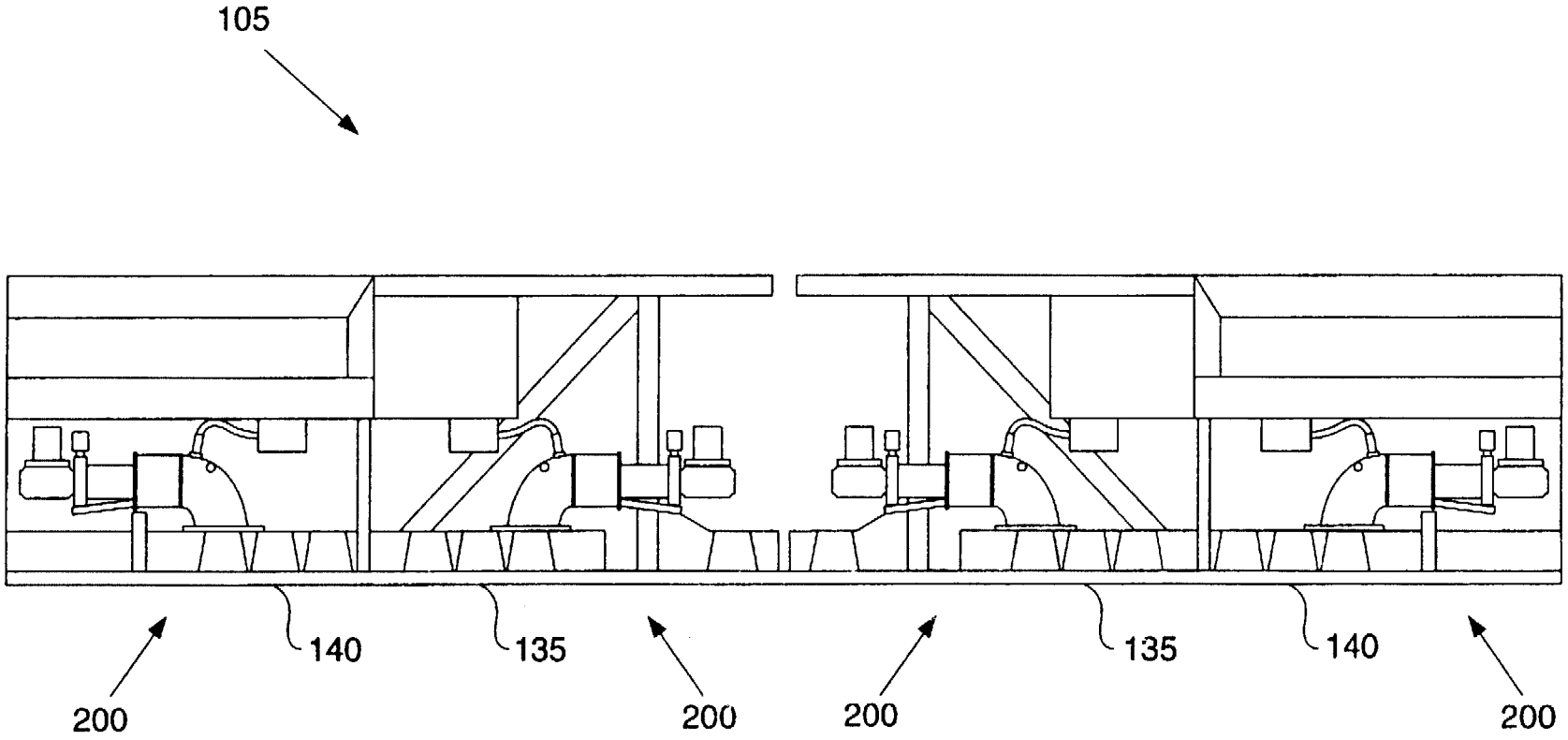
FIG. 3 illustrates a rear view of a screed assembly.

The rear view of the screed assembly 105 is illustrated with reference to FIG. 3. As shown, the screed assembly is comprised of left and right sections, each of which include two screed segments, e.g., a main screed segment and an extension screed segment. Each screed segment includes a burner 200 that is used to heat the associated screed segment.

Figure 4:
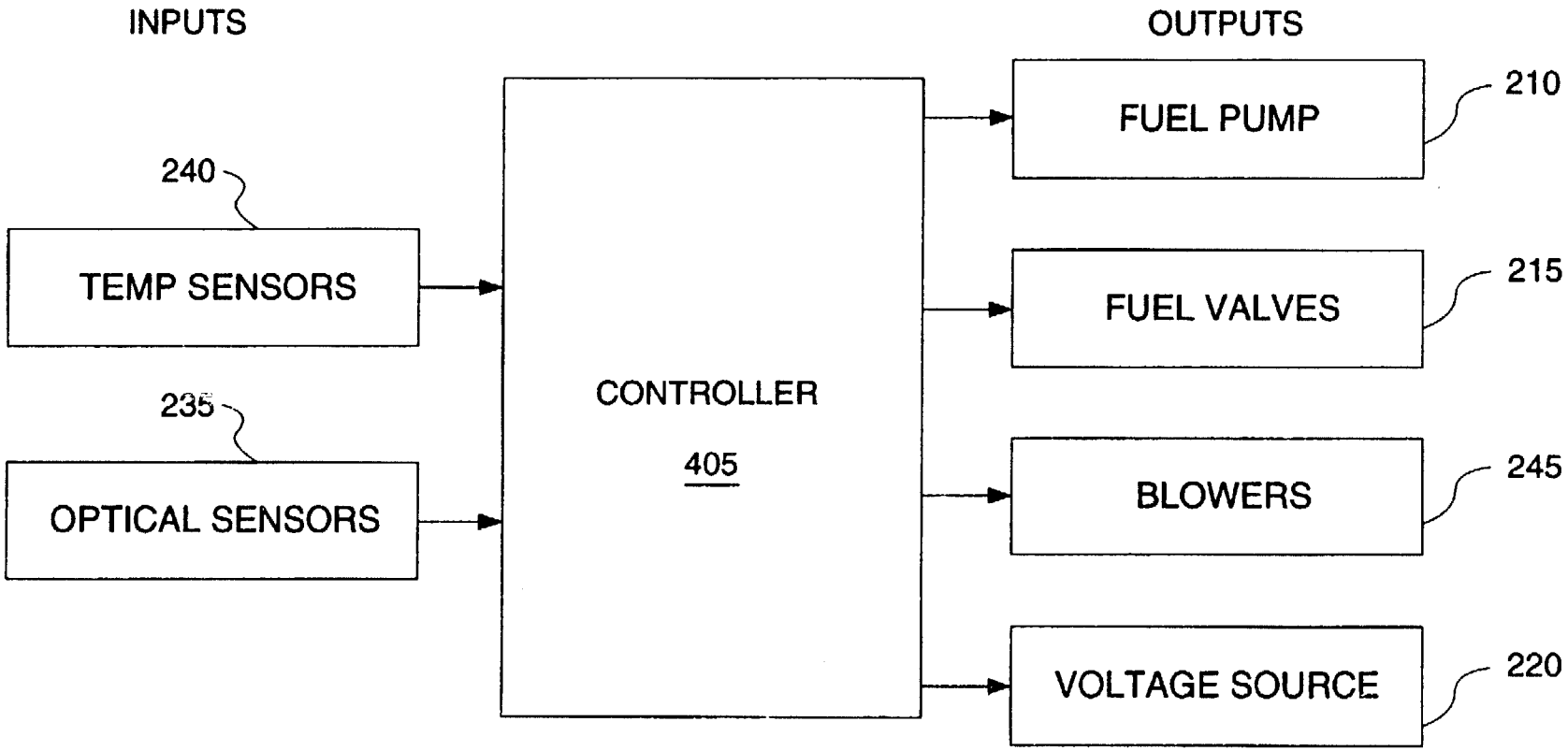
FIG. 4 illustrates a block diagram of a microprocessor based electrical control system that controls the operation of the burner.

Advantageously, the present invention controls the operation of each burner automatically. A block diagram of the electrical control system is illustrated in FIG. 4. A temperature sensor 240 produces a signal having a magnitude indicative of the temperature of a corresponding screed plate 230. Preferably, the temperature sensor 240 includes a thermocouple. An optical sensor 235 produces a signal that is indicative of the burner flame being present. Preferably, the optical sensor 235 includes a photocell. Note that, the temperature and optical sensors may equally include an "RTD", thermo switch, thermocouple, photocell, or the like.

A microprocessor based controller 405 receives the temperature signal and compares the magnitude of the temperature signal to a lower set point which is pre-programmed into the controller 405. The controller 405 controls operation of the blower 245 at a high speed setting for a predetermined period of time to aid in purging gases from the combustion chamber 205. Controller 405 energizes the fuel pump 210 to dispense fuel in the corresponding combustion chamber in response to the temperature signal magnitude being less than the lower set point. Once the gases are purged from the combustion chamber 205, the controller 405 energizes the voltage source 220 to cause the glow plug 225 to preheat. Additionally, the controller 405 energizes the fuel valve 215 and controls operation of the blower 245 at a low speed setting to aid the ignition process.

Once the optical sensor 235 detects the burner flame being present, the resulting ignition signal is delivered to the controller 405, which controls operation of the blower 245 at a high speed setting to increase the intensity of the combustion. Thereafter, the controller 405 compares the magnitude of the temperature signal to an upper set point. Once the temperature signal magnitude becomes greater than the upper set point, the controller 405 de-energizes the fuel pump 210, fuel valve 215, and voltage source 220.

Figure 5:
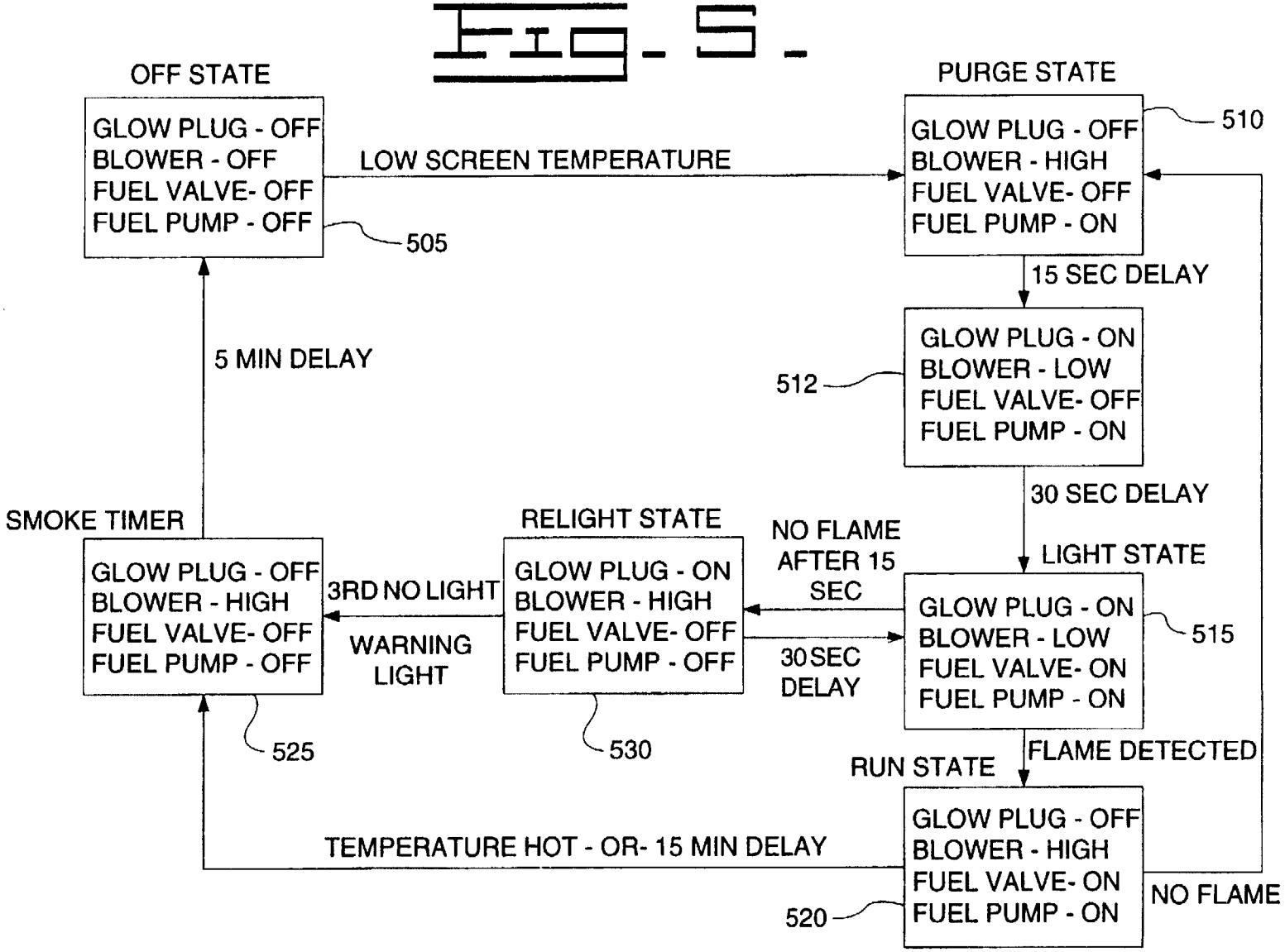
FIG. 5 illustrates a state diagram of the program control that is associated with the electrical control system.

Referring now to FIG. 5, a state diagram of the program control that is embedded in the firmware of the controller 405 is shown. Note that, although the state diagram is described as controlling a single burner, the same logic is applicable to all burners. Further, it is to be recognized that the program control may be used to automatically control the operation of the burners individually, sequentially, or simultaneously.

Initially, at block 505, all system components are turned off. Once the temperature of the screed falls below the lower set point, e.g., 250° F., the control proceeds to block 510. At block 510, any fumes that are contained in the combustion chamber are "purged" by energizing the blower and forcing air at a high speed across the chamber for a predetermined time period, e.g., 15 seconds. The effect of purging the combustion chamber minimizes excessive combustion during initial ignition, which can be problematic with some fuels. In addition, the fuel pump is energized in response to the temperature signal magnitude being less than the lower set point.

After the duration of the predetermined time period, control proceeds to block 512 wherein once the gases are purged from the combustion chamber, the controller energizes the voltage source to cause the glow plug to preheat. Additionally, the controller energizes the blower to operate at a low speed setting to aid the ignition process for a predetermined time period, e.g., 30 seconds.

After the duration of the predetermined time period, control proceeds to block 515 where the fuel valve is energized to dispense fuel in the combustion chamber and the glow plug, being fully energized, ignites the dispensed fuel. During ignition, the blower is operated at a low speed setting to mix the air and fuel in order to enhance ignition. Further, the low blower speed also provide a positive air pressure which directs the combustion flame and smoke toward the screed plate and away from other system components, i.e., the optical sensor.

Once ignition is detected, the control proceeds to block 520, where the glow plug is de-energized and the blower is operated at a high speed setting so that air is forced into the combustion chamber in order to increase the intensity of the combustion, which in turn, increases the temperature of the screed.

Once the screed temperature rises above the upper set point, e.g., 350° F., or a predetermined delay period has elapsed, e.g., 15 minutes, control transfers to block 525. However, if the resulting combustion flame has extinguished prior to the screed temperature reaching the upper set point or prior to the predetermined delay period elapsing, then the control returns to block 510 to "relight" the burner.

At block 525, the blower is set to a high speed setting in order to clear the combustion chamber of the smoke and gasses that resulted from the combustion. The blower will remain on "high" for a predetermined time period, e.g., 5 minutes, after which time the control returns to block 505, wherein the system is ready for a new burner cycle when the screed temperature drops below the lower set point.

Referring back to block 515, if a combustion flame did not occur within a predetermined time period, e.g. 15 seconds, then the control transfers to block 530. At block 530, the blower is reset to "high" in order to clear the combustion chamber of any fumes. After a predetermined time period, e.g., 30 seconds, the control returns to block 515 to attempt another "lighting" sequence. However, after a predetermined number of failed ignitions (a predetermined number of times sequencing through blocks 515 and 530), control transfers to block 525 for an indefinite time period. Note that, a warning light may be illuminated in response to a burner lighting problem or other electrical/combustion problems in order to warn the operator of a possible burner malfunction.

Thus, while the present invention has been particularly shown and described with reference to the preferred embodiment above, it will be understood by those skilled in the art that various additional embodiments may be contemplated without departing from the spirit and scope of the present invention.

We claim:

1. An apparatus for automatically controlling the temperature of a screed associated with an asphalt paving machine, the apparatus comprising:

a burner assembly having a combustion chamber;

a temperature sensor that senses the screed temperature and produces a signal having a magnitude indicative of the screed temperature;

means for dispensing fuel in the combustion chamber;

means for igniting the fuel in the combustion chamber, said means for igniting comprising a glow plug;

a variable speed blower for forcing air across the combustion chamber;

means for sensing when ignition occurs and responsively producing a signal indicative of the ignition; and control means for receiving the temperature signal, comparing the magnitude of the temperature signal to a lower set point, and initiating the means for dispensing fuel and the means for igniting to ignite the fuel in order to increase the screed temperature in response to the screed temperature being less than the lower set point;

wherein once ignition occurs, said control means causes said means for igniting to de-energize, compares the temperature signal to an upper set point, causes the means for dispensing fuel to stop dispensing fuel in response to the screed temperature being greater than the upper set point, and causes operation of the blower to continue for a predetermined period of time after combustion ceases to purge gases from the combustion chamber.

2. An apparatus, as set forth in claim 1, wherein the control means receives the ignition signal and controls the operation of the blower from a low speed to a high speed in order to increase the intensity of the combustion.

3. An apparatus, as set forth in claim 2, wherein the temperature sensor includes a thermocouple.

4. An apparatus, as set forth in claim 3, wherein the means for sensing when ignition occurs includes an optical detector.

5. An apparatus, as set forth in claim 4, wherein the means for dispensing fuel includes an electrically controlled fuel pump that delivers fuel to a solenoid actuated fuel valve.

6. An apparatus, as set forth in claim 5, including a voltage source that energizes the glow plug.

7. A method for automatically controlling the temperature of a screed associated with an asphalt paving machine, the asphalt paving machine including a burner assembly having a combustion chamber, the method comprising the steps of:

sensing the screed temperature and producing a temperature signal having a magnitude indicative of the screed temperature;

receiving the temperature signal and comparing the temperature signal magnitude to a lower set point;

causing fuel to dispense and subsequently ignite in the combustion chamber in response to the temperature signal magnitude being less than the lower set point;

sensing when ignition occurs and producing a signal indicative of the ignition;

receiving the ignition signal and operating a variable speed blower at a high speed to force air across the combustion chamber and thereby increase the intensity of combustion;

comparing the temperature signal magnitude to an upper set point;

stopping the combustion in response to the temperature signal magnitude being greater than the upper set point; and continuing forcing air across the combustion chamber for a predetermined period of time after combustion ceases to purge gases from the combustion chamber.

8. The method as recited in claim 7, wherein the step of causing fuel to dispense and subsequently ignite includes the step of operating said variable speed blower at a low speed to aid ignition.

* * * * *